US006621459B2

(12) United States Patent
Webb et al.

(10) Patent No.: US 6,621,459 B2
(45) Date of Patent: Sep. 16, 2003

(54) PLASMA CONTROLLED ANTENNA

(75) Inventors: George W. Webb, Del Mar, CA (US); Susan G. Angello, Bonita, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/060,650

(22) Filed: Jan. 30, 2002

(65) Prior Publication Data

US 2002/0140624 A1 Oct. 3, 2002

Related U.S. Application Data

(60) Provisional application No. 60/265,681, filed on Feb. 2, 2001.

(51) Int. Cl.[7] ..... H01Q 19/10
(52) U.S. Cl. ..... 343/754; 343/755; 343/910
(58) Field of Search ..... 343/701, 754, 343/755, 909, 910

(56) References Cited

U.S. PATENT DOCUMENTS

| | | | | |
|---|---|---|---|---|
| 5,084,707 | A | 1/1992 | Reits | 342/376 |
| 5,159,486 | A | 10/1992 | Webb | 359/299 |
| 5,262,796 | A | 11/1993 | Cachier | 343/909 |
| 5,360,973 | A | 11/1994 | Webb | 250/370.01 |
| 5,585,812 | A | 12/1996 | Reits | 343/910 |
| 5,694,498 | A | 12/1997 | Manasson et al. | 385/15 |
| 5,736,966 | A | 4/1998 | Reits | 343/910 |
| 5,864,322 | A | 1/1999 | Pollon et al. | 343/909 |
| 6,313,803 | B1 | 11/2001 | Manasson et al. | 343/756 |

OTHER PUBLICATIONS

George Webb et al.; "Light–Controlled MMW Beam Scanner" 1993 SBMO International Microwave Conference/ Brazil Proceedings.

Webb et al.; "MMW Beam Scanner Controlled by Light" Proceedings of the Workshops on Millimeter–Wave Power Generation and Beam Control; Sep. 1993.

Webb et al.; "Photonically Controlled 2–D Scanning Antenna" PSAA–8 Proceedings of the Eighth Annual DARPA Symposium on Photonic Systems for Antenna Applications; Jan. 13, 14, and 15, 1998.

Webb et al.; "Experiments on an Optically Controlled 2–D Scanning Antenna" Proceedings of the 1998 Antenna Application Symposium; Sep. 16–18, 1998.

Webb et al.; "Optically Controlled Millimeter Wave Antenna"International Topical Meeting on Microwave Photonics; Nov. 17–19, 1999.

Webb et al.; "Novel Photonically Controlled Antenna for MMW Communications" Microwave Photonics MWP 2000; Sep. 11–13, 2000.

*Primary Examiner*—Michael C. Wimer
(74) *Attorney, Agent, or Firm*—Renner, Otto, Boisselle & Sklar

(57) ABSTRACT

An improved plasma controlled millimeter wave (MMW) or microwave ($\mu$W) antenna is provided. A plasma of electrons and holes is photo-injected into a photoconducting wafer. A special distribution of plasma and a MMW/$\mu$W reflecting surface behind the wafer allows the antenna to be generated at low light intensities and a 180° phase shift (modulo 360°) to be applied to selected MMWs/$\mu$Ws.

17 Claims, 8 Drawing Sheets

35 GHz Beam, 0 deg. Off-Axis

35 GHz Beam, 30 deg. Off-Axis

PLASMA CONTROLLED ANTENNA

CROSS-REFERENCE TO RELATED APPLICATION

The present invention claims priority under 35 USC §119 to provisional application Ser. No. 60/265,681, filed on Feb. 2, 2001, the entire disclosure of which is incorporated herein by reference.

This invention was made with Government support under Contract DAAHO1-98-C-R060 awarded by the U.S. Army Aviation and Missile Command. The Government has certain rights in the invention.

TECHNICAL FIELD

The present invention relates generally to a scanning antenna. More particularly, the present invention relates to a plasma controlled scanning antenna operable in the microwave ($\mu$W) or millimeter wave (MMW) bands, for example.

BACKGROUND OF THE INVENTION

Scanning antennas are necessary to form and scan an electromagnetic beam. Historically, there have been generally two types of scanning antennas, either mechanically scanned or electronically scanned. Mechanically scanned antennas perform scanning by forming a fixed beam with the antenna and physically moving the antenna. Electronically scanned antennas have been based on phased arrays which often employ hundreds to thousands of phase shifters to individual elements or groups of elements.

Mechanically scanned antennas are generally slower than desired and require precision hardware which is often expensive. Because mechanically scanned antennas rely on moving parts, reliability is an issue. Electronically scanned phased array antennas offer many advantages, but the large numbers of phase shifters make such systems costly.

Accordingly, alternative scanning methods have been of recent interest. Generally, these alternative methods are motivated by a desire for higher performance at lower cost. For example, a non-mechanical scanning antenna, without phase shifters, has been developed and is based on a type of Fresnel zone plate. The antenna forms and steers a beam of millimeter wave or microwave radiation using a light-modulated photoconducting wafer. See, e.g., U.S. Pat. No. 5,159,486 to Webb, entitled "Instrumentation apparatus and methods utilizing photoconductors as light-modulated dielectrics"; U.S. Pat. No. 5,360,973 to Webb, entitled "Millimeter Wave Beam Deflector"; Webb et al., "Light-Controlled MMW Beam Scanner", Proc. 1993 SBMO International Microwave Conference, Vol. II, Sao Paolo, Brazil, IEEE Cat. No. 93TH0555-3, p. 417; and Webb et al., "MMW Beam Scanner Controlled by Light", Proc. Workshop on Millimeter-Wave Power Generation and Beam Control, Huntsville, Ala., Special Report RD-AS-944, U.S. Army Missile Command, 1993, p. 333, the entire disclosures of which are incorporated herein by reference.

As another alternative, antennas have been developed which use at least two thin semiconductor reflecting plates (e.g., silicon) which are supported (e.g., on glass) and separated by a synthetic foam spacer of dielectric constant near one. There are, however, disadvantages associated with such technique. The use of two or more plates presents complications which require the spacing of the plates to be controlled. A synthetic foam spacer is fragile and easily damaged either mechanically or by temperature. The use of thin plates, especially in the case of silicon of about 50–200 $\mu$m in thickness, makes it difficult to achieve the required plasma density under photo-injection because of the effect of surface mediated recombination in the thin plates. See, e.g., U.S. Pat. Nos. 5,084,707, 5,585,812 and 5,736,966, each to Reits.

Recently, antennas have been disclosed which use a single photoconducting plate, e.g. silicon, and a transparent millimeter wave reflector. See, e.g., Webb et al., "Photonically Controlled 2-D Scanning Antenna," PSAA-8 Proceedings of the Eighth Annual DARPA Symposium on Photonic Systems for Antenna Applications, The Naval Postgraduate School, Monterey, Calif., Jan. 13–15, 1998 (available from DTIC No. AD-B233444); Webb et al., "Experiments on an Optically Controlled 2-D Scanning Antenna," 1998 Antenna Applications Symposium, Allerton Park, Monticello, Ill., Sep. 16–18, 1998, p. 99; Webb et al., "Optically Controlled Millimeter Wave Antenna," Proceedings International Topical Meeting on Microwave Photonics, Melbourne, Australia, Nov. 17–19,1999, p.275; and Webb et al., "Novel Photonically Controlled Antenna for MMW Communications," Proceedings International Topical Meeting on Microwave Photonics MWP 2000, Oxford UK, Sep. 11–13, 2000, p. 97. However, there is no indication of optimum thickness of the photoconducting plate, the nature of the transparent millimeter wave reflector, or the MMW phase relations of the wafer which are desirable for best performance.

In view of the aforementioned shortcomings associated with existing scanning antennas, there remains a strong need in the art for a further improved scanning antenna.

SUMMARY OF THE INVENTION

An improved plasma controlled millimeter wave (MMW) or microwave ($\mu$W) antenna is provided in accordance with the present invention. A plasma of electrons and holes is photo-injected into a photoconducting wafer. A special distribution of plasma and a MMW/$\mu$W reflecting surface behind the wafer allows the antenna to be generated at low light intensities and a 180° phase shift (modulo 360°) to be applied to selected MMWs/$\mu$Ws. The selected phase change produces superior performance over similar antennas without the phase change.

As is known, Fresnel zone plates (FZP) are of two general types, blocking and phase correcting. The simplest form of FZP works by blocking radiation. Rays going through different parts of an aperture add in-phase or out-of-phase at a detection point. If those rays which add out of phase are blocked, then there is a large gain in received intensity. Generally the phase conditions which produce a large increase in power are present in a given direction and thus the FZP produces a beam of radiation in that direction.

In previous transmissive-type antennas, a technique was used which involved a transient blocking FZP in which a spatially varying density of plasma of charge carriers, electrons and/or holes, was created by optical injection into a semiconductor or photoconductor wafer. The un-illuminated parts of the photoconductor with no plasma allow incident MMW from a feed behind the wafer to be transmitted through the wafer. In the illuminated regions, however, the photo-injected charge carriers alter the index of refraction of the wafer locally. At sufficient light intensity the plasma density was large enough to substantially block MMW in those local lighted regions; at large enough plasma density the plasma caused the transmitted MMW to asymptotically approach zero in magnitude. The wafer, modified by light in this way, is made to diffract incident radiation into a beam and thus comprised a transient FZP. Because the wafer responds rapidly to changes in optical injection, it is possible to change rapidly transient Fresnel diffractive conditions and thus rapidly change the beam direction.

In accordance with an exemplary embodiment of the present invention, a MMW feed is positioned in front of the wafer and an optically transparent MMW reflecting surface (reflector) is positioned in close proximity to the back surface of the wafer. The reflector is designed to be highly reflecting to MMW but transmit visible or infrared light of a wavelength below the band gap of the wafer in order to photo-inject plasma. A controllable light source behind the reflector can be positioned close to the reflector to minimize the need for focusing optics for the light patterns. The wafer thickness is chosen to be nominally an odd integer multiple of the wavelength of the MMW in the wafer material. With this choice of parameters MMW incident on a lighted region of the wafer containing plasma will be phase shifted by nominally 180° from MMW incident on a dark region.

These features of the present invention enable two advantageous modes of operation. One mode is an improved blocking FZP antenna, and the second mode is as a phase correcting FZP which uses all the incident MMW radiation. As a blocking FZP antenna, a low plasma density can be chosen which provides for the principle of destructive interference to be used to completely block the undesired out-of-phase MMW. With proper control of phase in the MMW this blockage can be made to be complete, not just asymptotically approaching zero, and at much lower plasma density than in previous designs. The fact that a lower plasma density is suitable for operation allows for much less light intensity and electrical power to be used.

The second mode of operation, the phase correcting FZP, occurs at higher plasma density for the regions containing the out-of-phase rays. In this case when the plasma density created is large enough, the MMW are reflected from the front surface of the wafer. Because the wafer thickness is nominally an odd integer multiple of the wavelength of the MMW in the wafer material, the MMW reflected from the front surface of the wafer are given a 180° phase shift with respect to MMW in the dark regions which make a double pass through the wafer. In this way, the out-of-phase rays are given a 180° phase shift and thus constructively interfere in the beam. A large increase in beam power and antenna efficiency results.

The present invention is described primarily in the context of an antenna designed to operate in the MMW band. However, it will be appreciated that the antenna may instead operate in other radio frequency (RF) bands such as the microwave ($\mu$W) band. For example, an antenna according to the present invention may be designed to operate anywhere in the range of 4 gigahertz (GHz) to 400 GHZ.

According to one particular aspect of the invention, a plasma controlled reflector antenna is provided. The antenna includes a reflector configured to reflect radio frequency (RF) radiation having a frequency equal to that of an operating frequency of the antenna. In addition, the antenna includes a feed for illuminating the reflector with and/or receiving from the reflector RF radiation at the operating frequency to transmit/receive RF radiation. A Fresnel zone plate (FZP) wafer is also included adjacent the reflector and interposed between the reflector and the feed. The FZP wafer has a thickness substantially equal to $n*\lambda vac/(4*N)$, where n is an odd integer, $\lambda vac$ is the free space wavelength of RF radiation at the operating frequency, and N is the index of refraction of a material of which the wafer is made, in a non-plasma injected state. Furthermore, the antenna includes a controllable light source for projecting a controlled light pattern onto the FZP wafer to inject selectively plasma into regions of the FZP wafer illuminated by the light pattern, thereby creating regions in a plasma injected state and regions in a non-plasma injected state.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF THE PREFERRED EMBODIMENTS

Figure 1:
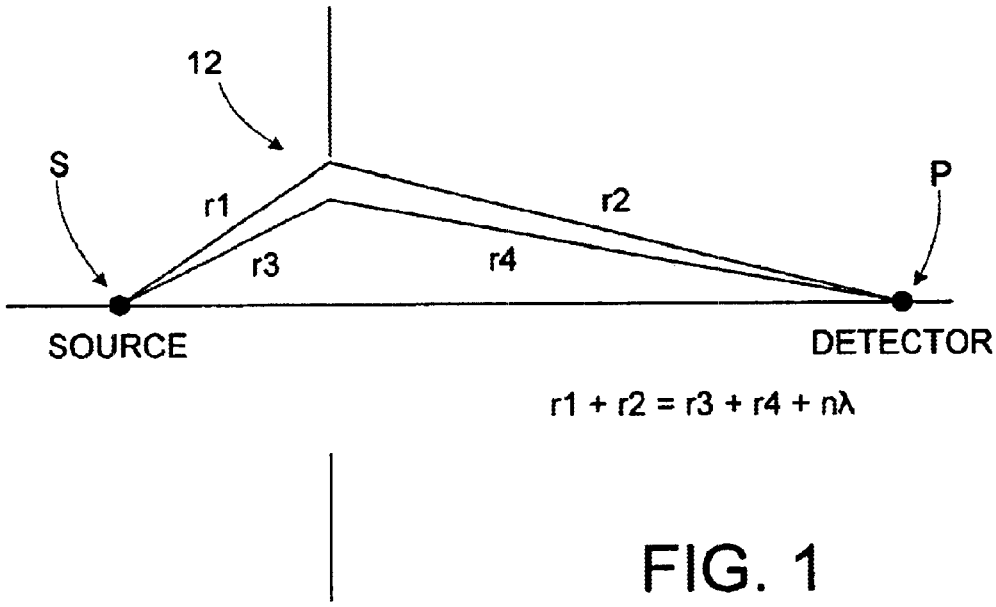
FIG. 1 illustrates path length dependence and condition for constructive interference for rays between a source and a detection point.

The present invention will now be described in detail with reference to the drawings, wherein like reference numerals are used to refer to like elements throughout.

Transient Fresnel Zone Plates (FZPS)

FIG. 1 shows MMW rays (r1+r2 & r3+r4) from a source S passing through an aperture 12 to a detection point P. The Fresnel zone plate (FZP) conditions provide that all such rays arrive at the detection point in constructive interference.

Figure 2:
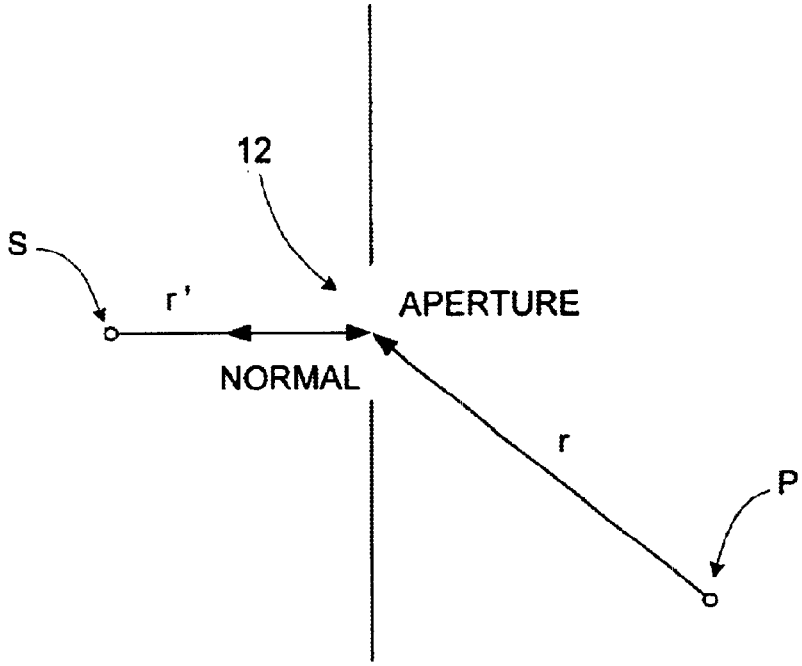
FIG. 2 is a schematic layout for a Fresnel-Kirchhoff solution for integrated amplitude Up for an antenna aperture, where Up at detection point P for MMW are emitted from S and passing through the aperture.

The FZP conditions can be understood with reference to FIG. 2 which shows an aperture 12 in an otherwise opaque screen. The amplitude of the radiation arriving at the detection point P, from a source S, is calculated by solving the Fresnel-Kirchhoff expression in the scalar amplitude approximation (see, e.g., G. R. Fowles, Introduction to Modem Optics, 2nd Ed., Dover Publ. New York, 1975.):

$$U_P = -\frac{ikU_0e^{-i\omega t}}{4\pi}\iint_{aperture}\frac{e^{ik(r+r')}}{rr'}[\cos(n,r)-\cos(n,r')]dA$$

$$U_p = \text{integrated amplitude at } P$$

Figure 3A:
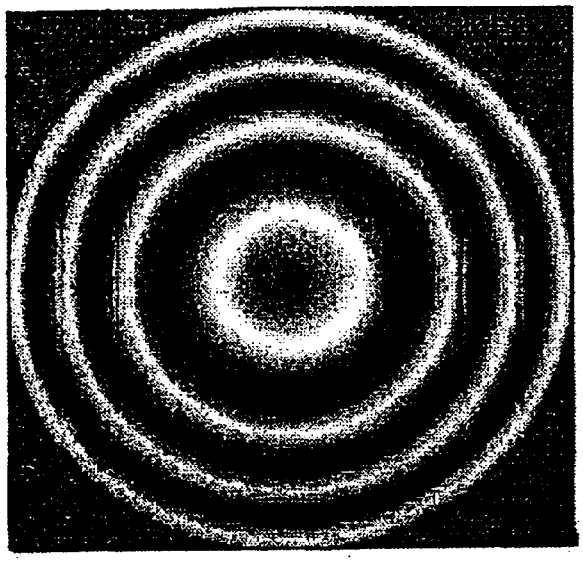
FIGS. 3A and 3B represent gray scale plots of phase at a detection point plotted on the plane of an aperture where a ray went through the aperture, for a source at 76 mm from 146 mm effective diameter aperture, distant detector, 35 GHz radiation, for a detector 0° off axis, and 30° off axis, respectively.
Figure 3B:
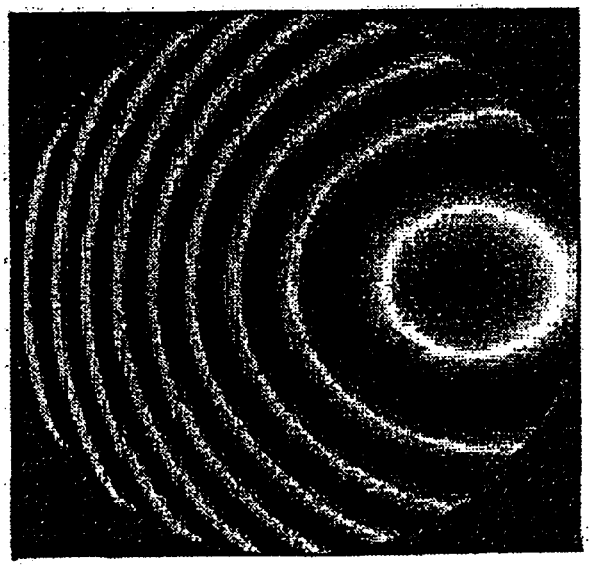

In general, rays arriving at P have a relative phase which depends on the point where they went through the aperture 12. The phase at P is determined by the exponential in the Fresnel-Kirchhoff relation and depends on the positions of S and of P. FIGS. 3A and 3B show two examples of phase. FIG. 3A shows the relative phase at the detection point P of a ray plotted with a gray scale on the plane of the aperture at the point where the ray passes through the aperture 12. In this case, the source point S and detection point P have been chosen to be collinear with the aperture 12. In FIG. 3A, those rays with phase represented from white to gray are taken to be in-phase and, conversely, those rays with phase from gray to black are out-of-phase. If the out-of-phase rays are blocked, for example by a photo-injected plasma, then the only rays arriving at point P would be in-phase and a large increase in intensity at P would result.

It is clear from FIG. 3A that the relative phase distribution displays the layout symmetry of S, P, and the aperture 12. In particular, the relative phase depends on the angle that point P makes with the axis of the aperture 12. If the relative position of P is moved off-axis, then the distribution of relative phase at point P is changed. FIG. 3B shows the phase distribution when point P is moved to 30° off-axis, all other parameters remaining the same. Therefore, it is evident to send a beam to this direction requires that a different ray distribution must be blocked. The two directions for point P in FIGS. 3A and 3B illustrate that to form a MMW beam in a specific direction it is desirable to inject a plasma selectively in a photoconductor. For photo-injection, light of wavelength below the band gap of the photoconductor is used. In order to send the beam in a new direction, the present invention is able to change the light pattern and thus the spatial distribution of the plasma. The present invention therefore utilizes a photoconducting material which is transmissive in the dark to MMW and responsive in the light, and a light source having a high degree of controllability.

A variety of photoconducting materials can be used in accordance with the invention. These include elemental semiconductors such as silicon and germanium, or a member of the category of III–V and II–VI compound semiconductors. For a controllable light source, computer controlled light arrays composed of LEDs or solid state lasers can be used (see, e.g., U.S. Pat. No. 5,360,973). Alternatively, another type of light source could be a steered laser beam, for example. For an optically transparent MMW reflector, a fine metal mesh, a fine grid of conducting metal lines deposited on a transparent substrate, or a coating such as indium tin oxide on a glass substrate can be effective in accordance with the present invention.

Figure 4:
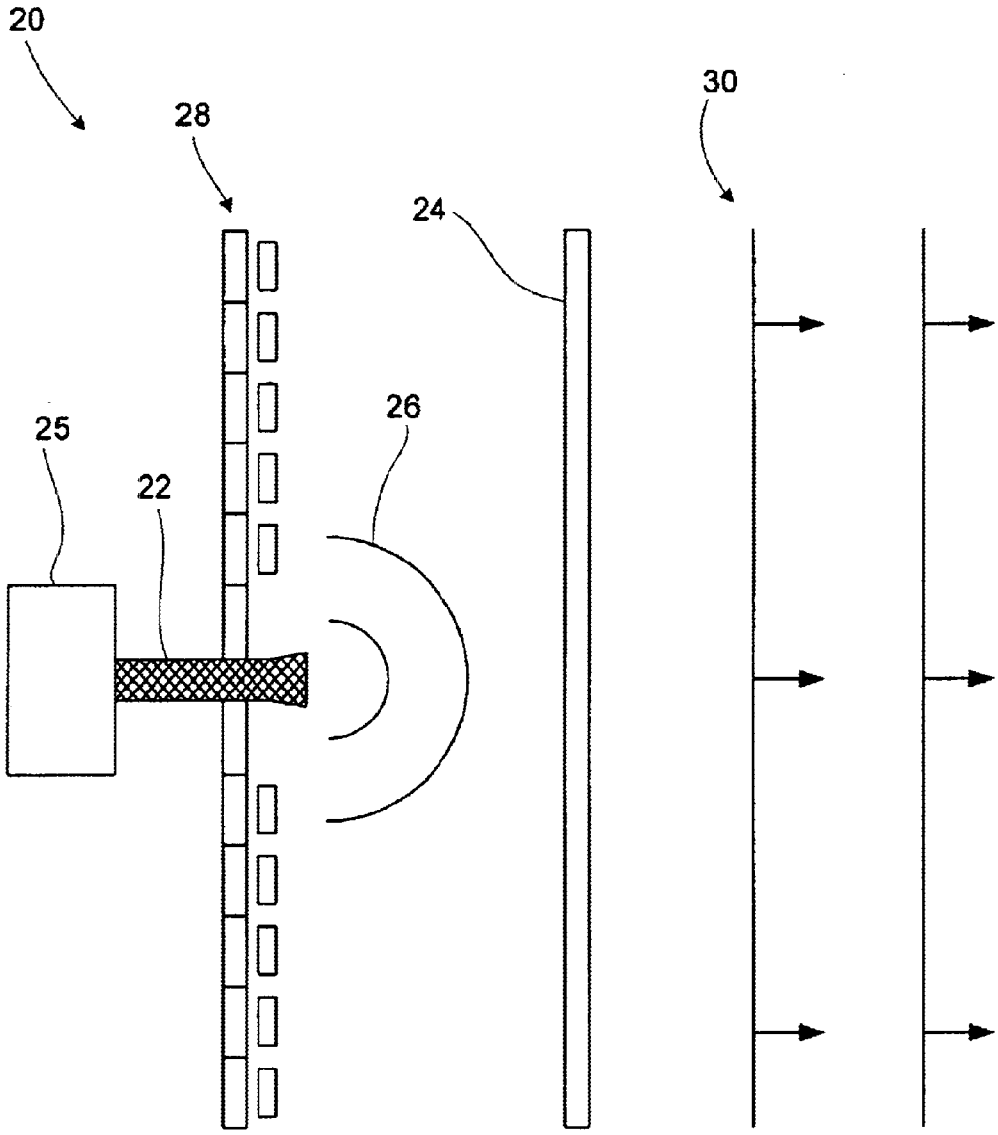
FIG. 4 illustrates a transmissive antenna configuration with back feed.

FIG. 4 illustrates a previously developed antenna architecture, generally designated 20. The antenna 20 includes a MMW feed 22 which is behind an FZP wafer 24 and coupled to a MMW source 25. The feed 22 transmits MMW radiation 26 toward the wafer 24. A programmable light array 28 projects a light pattern onto the wafer 24 to form a Fresnel lens shaped plasma within the wafer 24. The MMW radiation 26 which is not blocked by the pattern formed on the wafer 24 passes therethrough as radiated energy 30. There are, however, performance limitations to such architecture. Such performance limitations are addressed herein by the antenna architecture of the present invention as will now be described more fully.

New Reflective Antenna Architecture with Two Modes of Operation

Figure 5:
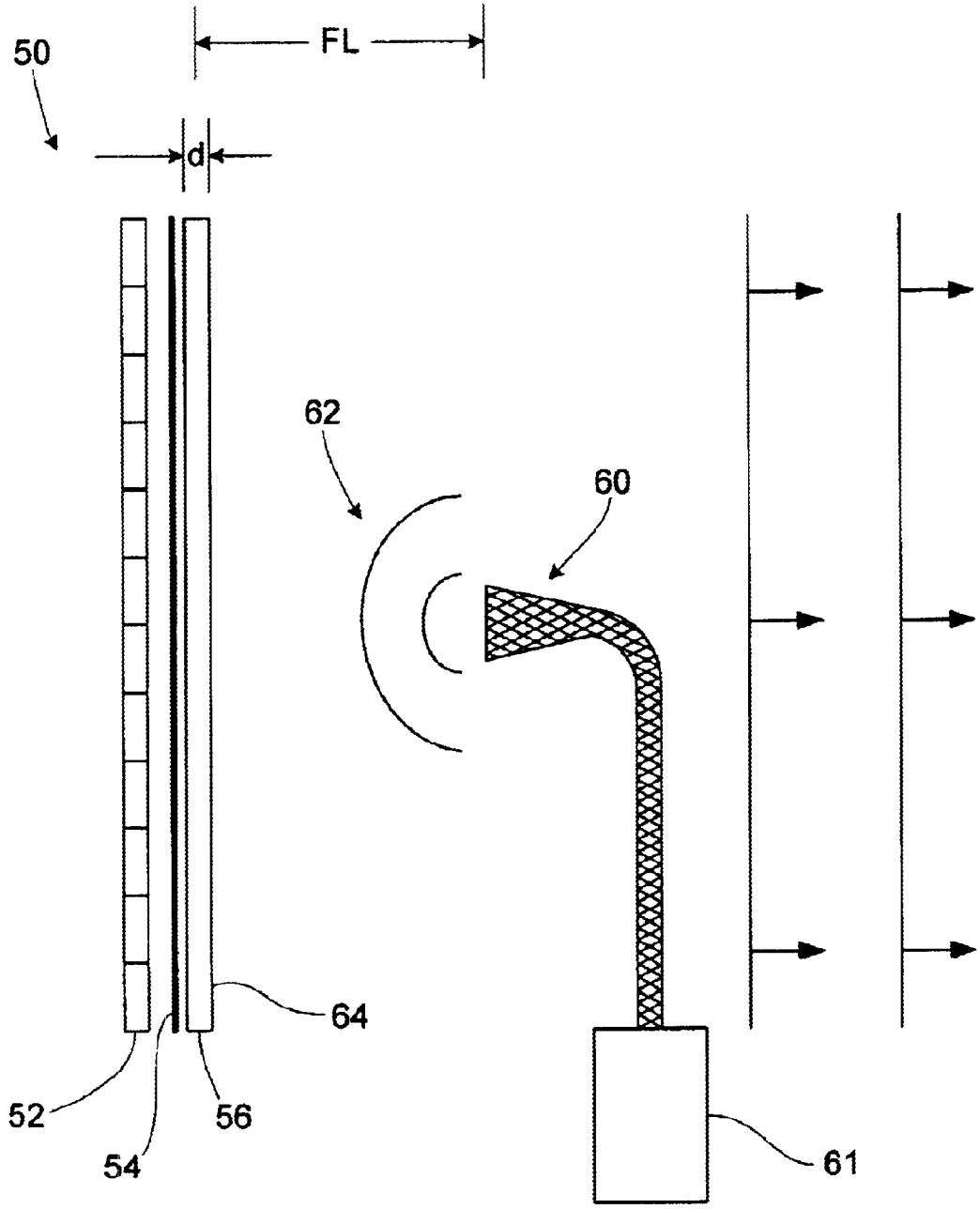
FIG. 5 is an exploded view of a reflective antenna in accordance with the present invention, in which the front feed emits MMW which impinge on special thickness photoconducting wafer which has an optically transparent MMW mirror or reflector at the back surface; the MMW pass through the wafer, are reflected at the back surface and re-emerge at the front surface; a controllable light source projects a light pattern through the transparent reflector onto the wafer creating plasma; and the plasma forms the MMW into a beam.

Referring now to FIG. 5, an antenna 50 having a reflective architecture is shown in accordance with the present invention. The antenna 50 includes a controllable light source 52 such as a computer controlled light array composed of LEDs or solid state lasers. Alternatively, the light source 52 could be a steered laser beam, for example. Moreover, it will be appreciated that any controllable light source emitting light of wavelength less than the band gap of the photoconducting material can be used. All are considered within the scope of the invention.

The antenna 50 further includes a MMW reflector 54 positioned in front of the light source 52. The reflector 54 is designed to allow the light from the light source 52 to pass therethrough, while serving to reflect incident MMW radiation. Exemplary constructions for the optically transparent MMW reflector 54 include a fine metal mesh, a fine grid of conducting metal lines deposited on a transparent substrate, or a coating such as indium tin oxide on a glass substrate. The thickness and spacing of the mesh or grid lines are selected so as to be effectively transparent at the higher optical frequencies of the light source 52, while serving as a reflector at the lower MMW frequencies. For example, in an antenna 50 designed to operate at 35 Gigahertz (Ghz), the MMW reflector 54 may be made of a 500 lines per inch metal mesh of wire having a size of $0.45\times10^3$ inch. Of course, other sizes are possible and will depend on the operating frequency of the antenna 50, etc., as will be appreciated by those having ordinary skill in the art.

In addition, the antenna 50 includes an FZP wafer 56 positioned in front of and preferably immediately adjacent the MMW reflector 54. As mentioned above, the wafer 56 is a photoconducting material which is transmissive in the dark to MMW, and is responsive in the light. A variety of photoconducting materials can be used as the wafer 56. Such materials include, but are not limited to, elemental semiconductors such as silicon and germanium, or a member of the category of III–V and II–VI compound semiconductors.

Finally, the antenna 50 includes an antenna feed 60 which is located in front of the wafer 56 at a distance FL corresponding to the desired focal length of the antenna 50. The feed 60 may be a small MMW horn or the like, as will be appreciated. Alternatively, the feed 60 may be embodied by a small subreflector in the case of a Cassegrain or backfire-feed type construction, for example. The feed 60 is connected to a MMW source 61 in the case where the antenna 50 serves to transmit. In addition, or in the alternative, the feed 60 is connected to a MMW receiver (not shown) in the case where the antenna 50 serves to receive.

In the case where the antenna 50 is a transmitting antenna, the feed 60 transmits MMW radiation 62 towards the wafer 56. The controlled light source 52 projects a light pattern through the reflector 54 onto the back of the wafer 56. The back surfaces of those regions of the wafer 56 which have been illuminated by the light source 52 have plasma photo-injected therein, and the plasma diffuses thru the wafer 56 towards the front surface. This causes the illuminated regions of the wafer 56 to reflect the MMW radiation 62 at the front face 64 of the wafer 56. The regions of the wafer 56 which are not illuminated by the light source 52 do not include plasma. These non-illuminated regions therefore allow the MMW radiation 62 to pass through those sections of the wafer 56 to the MMW reflector 54 therebehind. The MMW radiation 62 is then reflected by the MMW reflector 54 and passes back through the wafer 56 towards the feed 60.

According to the preferred embodiment of the antenna 50, the wafer 56 and reflector 54 satisfy certain specified conditions. A first condition is that the wafer 56 have a nominal thickness d that is an odd integral multiple of a quarter wavelength in the material, namely:

$$d=n*\lambda vac/(4*N)$$

n=1, 3, 5, . . .

Figure 6:
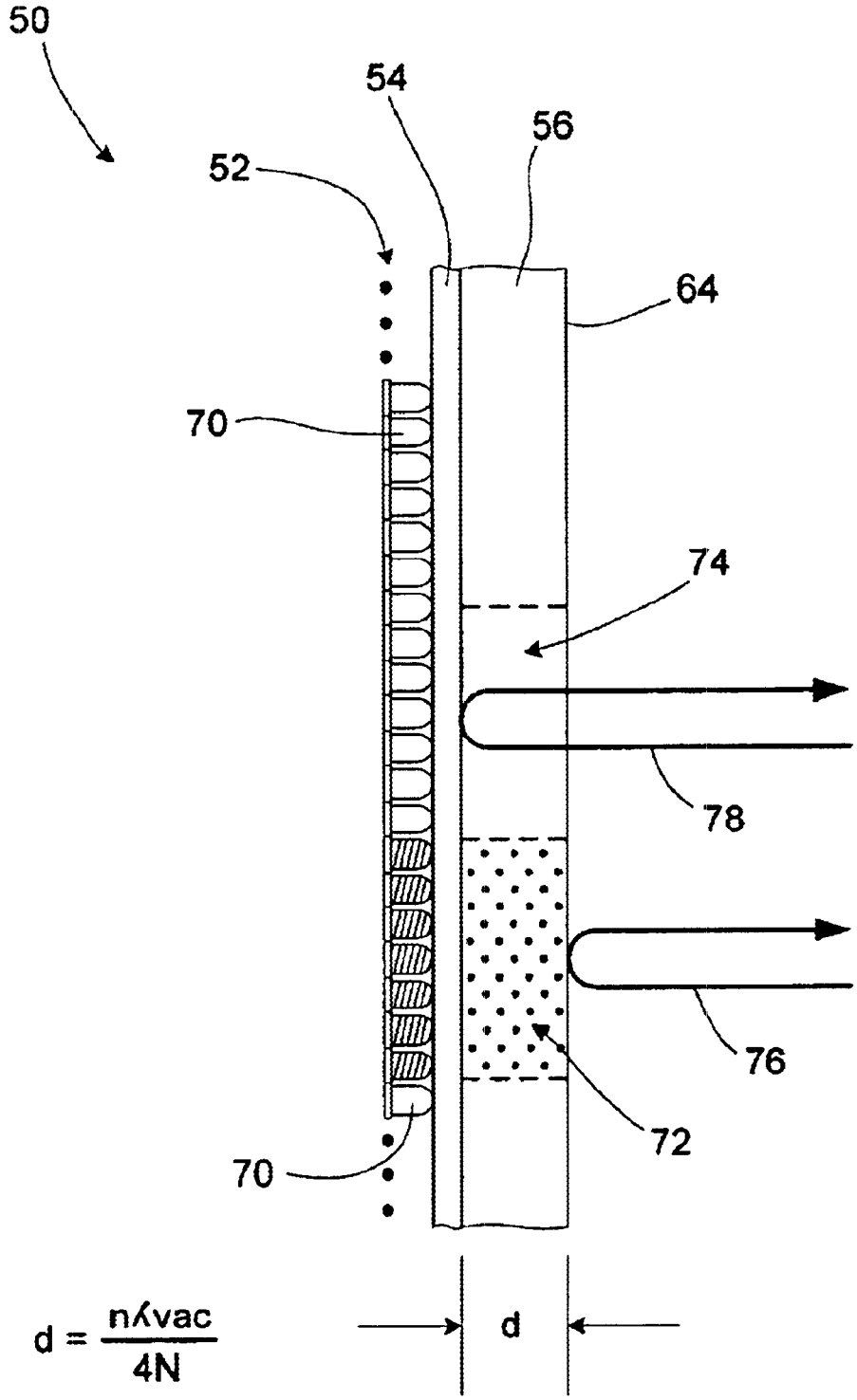
FIG. 6 is a cross-section of a reflective antenna in accordance with the present invention, with a $n*\lambda vac/(4*N)$ thick wafer and a 180° phase shift between in-phase zones without plasma and out-of-phase zones with plasma. Here n is an odd integer, n=1, 3, 5 . . . , $\lambda vac$ is the free space wavelength of the MMW radiation, and N is the index of refraction of the wafer material in the dark; assuming the ideal case, at low plasma density there is a 180° phase change on reflection at the back reflector and at high plasma density there is a 180° phase change on reflection at the front surface; the path length difference of $n*\lambda vac/(4*N)$ provides the desired overall phase shift of 180° (modulo 360°) between in-phase and out-of-phase zones.

N=index of refraction of wafer 56 in non-illuminated (dark) regions

λvac=is the free space wavelength of the MMW radiation 62 at the operating frequency As is shown in FIG. 6, the controlled light source 52 may include a plurality of LEDs 70 arranged in an array. By selectively illuminating the LEDs 70, heavy plasma density produces a 180° phase shift into the out-of-phase zones 72. With respect to those regions where the LEDs 70 are not illuminated, low plasma density (or "in-phase") zones 74 are provided. MMW radiation 76 which is incident on the high plasma density zones 72 incurs a 180° phase change on reflection at the front surface 64 of the wafer 56. Comparatively, MMW radiation 78 which is incident on the low plasma density zones 74 incurs a 180° phase change on reflection at the MMW reflector 54. The path length difference d=n*λvac/(4*N) provides the desired overall phase shift of 180° (modulo 360°) between in-phase and out-of-phase zones 74 and 72, respectively.

In order to maintain the proper phase relationships it is important that proper account of the dark state (i.e., low-plasma density state) refractive index of the wafer material, N, is taken into account in calculating the thickness d of the wafer 56. For example, in the case of an operating frequency of 35 Ghz and a silicon wafer 56 with a dielectric constant of approximately e=11.7, $$d=n*\lambda vac/(4*N)$$

N=sqrt e=3.42

λ=0.857 cm n=1

∴d=626 μm

It is also important that the MMW reflector 54 be in close proximity to the back surface of the wafer 56 as represented in FIG. 6. The afore-described configuration of the antenna 50 can be used as a blocking or phase correcting FZP, as will now be discussed.

Blocking FZP with Low Plasma Density Mode of Operation

Figure 7:
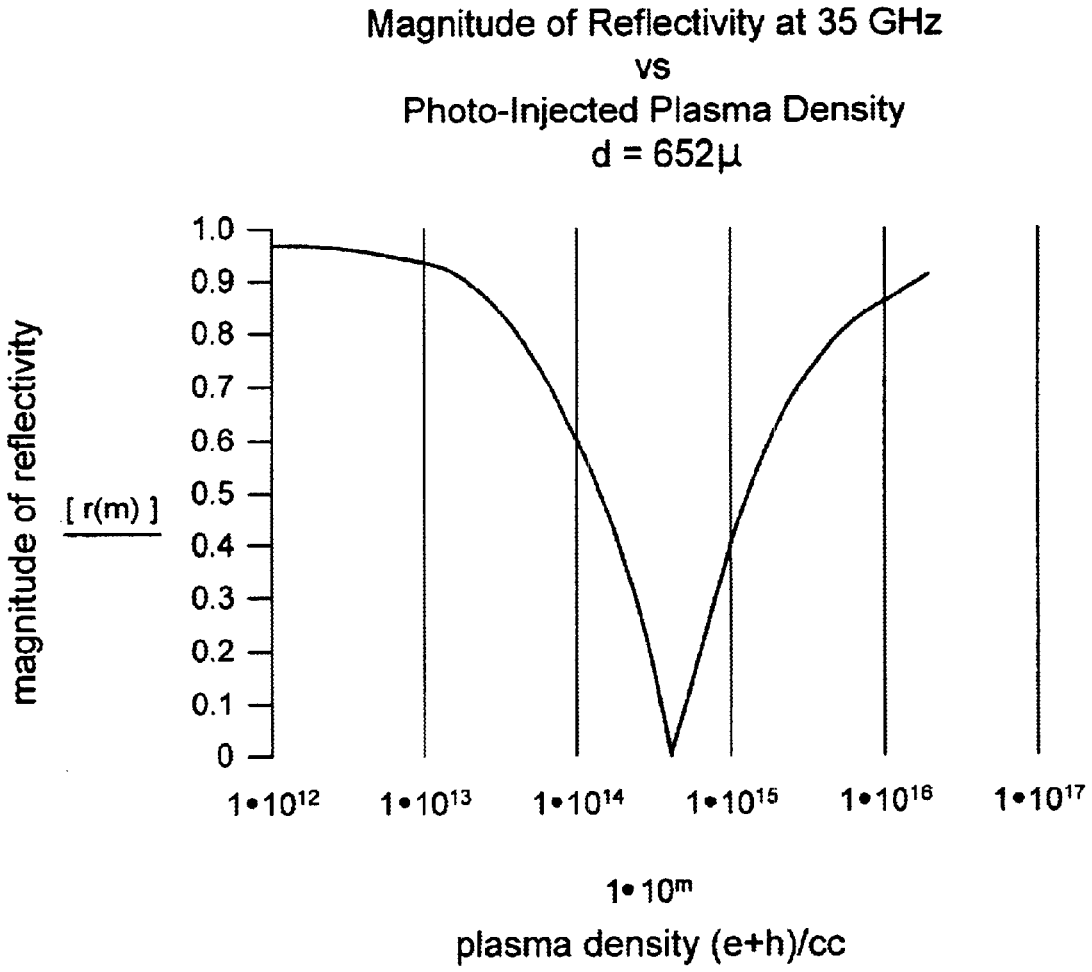
FIG. 7 illustrates the behavior of the magnitude of the reflectivity of an improved blocking FZP in accordance with the present invention; in this example, the calculation gives the reflectivity as a function of photo-injected plasma density of the wafer and reflector assembly of FIG. 6, assuming a semi-insulating silicon wafer of thickness 652 $\mu$m and 500 lines per inch metal mesh reflector of wire size $0.45\times10^{-3}$ in.; one will note the high reflectivity near 1 at lowest plasma density and the deep minimum in reflectivity near zero at a density of $4\times10^{14}$ $cm^{-3}$.

FIG. 7 shows the calculated 35 GHz reflectivity as a function of plasma density of the antenna construction shown in FIG. 6. This calculation was done for a silicon wafer 56 which was 652 μm in thickness. The wafer 56 was assumed to be n-type of residual impurity $3.3\times10^{12}$ $cm^{-3}$. This impurity level is representative of a semi-insulating silicon material of resistivity 1000 Ω-cm. The index of refraction of the silicon as a function of carrier density was calculated using standard techniques. The MMW reflector 54 was composed of metal mesh 500 lines per inch and wire size $0.45\times10^{-3}$ located at the back surface of the wafer 56. With plasma density increasing from zero it is seen that the reflectivity falls from near 1 (0.975) as plasma density increases and makes the wafer material slightly lossy. At plasma density of about $4.2\times10^{14}$ $cm^{-3}$ the reflectivity is near 0 indicating a near perfect cancellation of reflections from the reflector 54 and the wafer front surface 64.

To achieve perfect cancellation it is appropriate to optimize the thickness d of the wafer 56 slightly from quarter wavelength. The thickness of the wafer 56 for a quarter wavelength at 35 GHz is 626 μm as shown above. However, there is a slight phase shift from the ideal 180° upon reflection at the reflector 54. Accordingly, the thickness d of the wafer 56 was adjusted by 4 percent to 652 μm to give cancellation. The appropriate thickness adjustment may be determined empirically, for example, or via other means such a modeling techniques (See, e.g., M. Kohin et al., "Design of Transparent Conductive Coatings and Filters" in Infrared Thin Films, R. P. Shimshock Ed. Critical Reviews of Optical Science and Technology, Vol. CR 39).

It is calculated that to achieve a photo-injected plasma density of $4\times10^{14}$ $cm^{-3}$ requires a light intensity of only $7\times10^{-3}$ $W/cm^2$ or 7 $mW/cm^2$. This is a modest light intensity. Bright sunlight, for example, has an intensity of order 100 $mW/cm^2$. This calculation assumes a free carrier recombination time of 1000 μs which is realistic for carefully prepared silicon. To achieve a comparable level of blocking in a previous transmission mode antenna (see, e.g., U.S. Pat. No. 5,360,973) requires much higher plasma density. It is estimated that the plasma density in that case would have to be $3\times10^{15}$ $cm^{-3}$ with a corresponding increase in light intensity of almost an order of magnitude.

Thus the capability of operating at much lower light intensity reduces the power requirements on the light source 52 and the heating level on the wafer 56 which can be advantageous in low power applications.

Phase Correcting FZP with High Plasma Density Mode of Operation

The previously described blocking approach results in a loss of about 50% of the MMW amplitude from the beam. It is useful to estimate maximum efficiency or gain by noting that it can be shown that alternating in-phase and out-of-phase zones of FIG. 3 are of nearly equal area. If we suppress the dependence r and r' then we can approximate the total electric field intensity as a sum over in-phase and out-of-phase zones where the zones are assumed to have equal areas:

$$E = \int_{in\ phase\ zones} dE + \int_{out\ of\ phase\ zones} dE$$

$$E = E_0\left(\frac{1}{2\pi}\right)\int_{-\pi/2}^{\pi/2}\cos(\theta)\,d\theta + E_0\left(\frac{1}{2\pi}\right)\int_{\pi/2}^{-\pi/2}\cos(\theta)\,d\theta$$

$$E = \left(\frac{1}{\pi}\right)E_0 + \left(\frac{-1}{\pi}\right)E_0$$

$$E = \left(\frac{1}{\pi}\right)E_0 \text{ after blocking out of phase rays}$$

$$P \propto \left(\frac{1}{\pi}\right)^2 E_0^2 = 0.101E_0^2$$

Accordingly the overall gain of the antenna 50 is nearly −10 dB and the efficiency is 10.1%. Thus, the approach of blocking MMW is a penalty to antenna efficiency. A more exact numerical solution of the Fresnel-Kirchhoff expression for efficiency confirms this result.

However, as indicated in FIG. 6 if a uniform 180° phase shift is applied to the out-of-phase zones 72 rather than blocking them, then a large increase in maximum gain or efficiency would be produced:

$$E = \left(\frac{2}{\pi}\right)E_0 \text{ all zones contributing to beam}$$

$$P \propto \left(\frac{2}{\pi}\right)^2 E_0^2 = 0.405E_0^2$$

In that case, to the same approximation, the electric field would be doubled, the beam power increased by a factor of four, and the corresponding maximum efficiency to 40.5%. Once again, a more exact numerical solution of the Fresnel-Kirchhoff expression for efficiency confirms this result.

Figure 8:
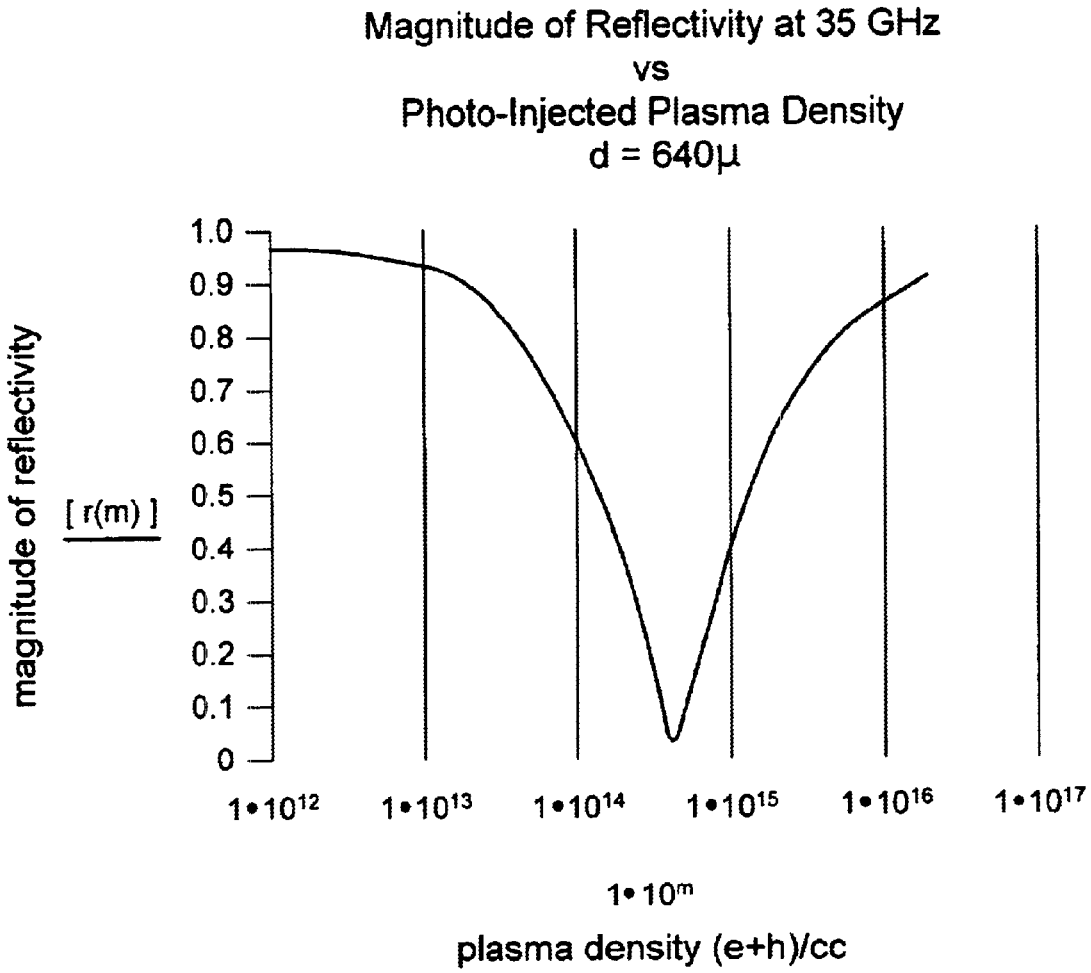
FIG. 8 illustrates the behavior of the magnitude of the reflectivity of an improved phase correcting FZP in accordance with the present invention; in this example, the calculation is for the reflectivity as a function of photo-injected plasma density of the wafer and reflector assembly of FIG. 6, assuming semi-insulating silicon wafer of thickness 640 $\mu$m and 500 lines per inch metal mesh reflector of wire size $0.45\times10^{-3}$ in; one will note the high reflectivity near 1 at lowest plasma density and the reflectivity rising to 0.9 at a plasma density of $2\times10^{16}$ $cm^{-3}$; between the lowest and highest plasma density the phase of the reflectivity goes through a 180° phase change.

FIG. 8 shows the 35 GHz reflectivity of a silicon wafer 56 and metal mesh reflector 54 as a function of plasma density. The same wafer 56 and metal mesh reflector 54 parameters were assumed as in FIG. 7 except that a wafer thickness was adjusted slightly to 640 $\mu$m was used. The reason for this slight adjustment of thickness is given below.

In FIG. 8 it is seen that with plasma density increasing from zero, the reflectivity decreases from near 1 (0.975) as plasma density increases and makes the wafer material slightly lossy. At plasma density of about $4.2\times10^{14}$ cm$^{-3}$ the reflectivity decreases to a minimum value of 0.05 indicating that not quite perfect cancellation of reflections from the reflector 54 and wafer front surface 64 can be achieved. With increasing plasma density the reflectivity increases reaching 0.9 at the highest density assumed of $2\times10^{16}$ cm$^3$.

The thickness of 640 $\mu$m represents a 2% adjustment from the quarter wavelength thickness at 35 GHz which is 626 $\mu$m. It is desirable to account for the slight phase shift upon reflection at the reflector 54, and the phase shift at the front surface 64 at the highest plasma density light intensity used.

Figure 9:
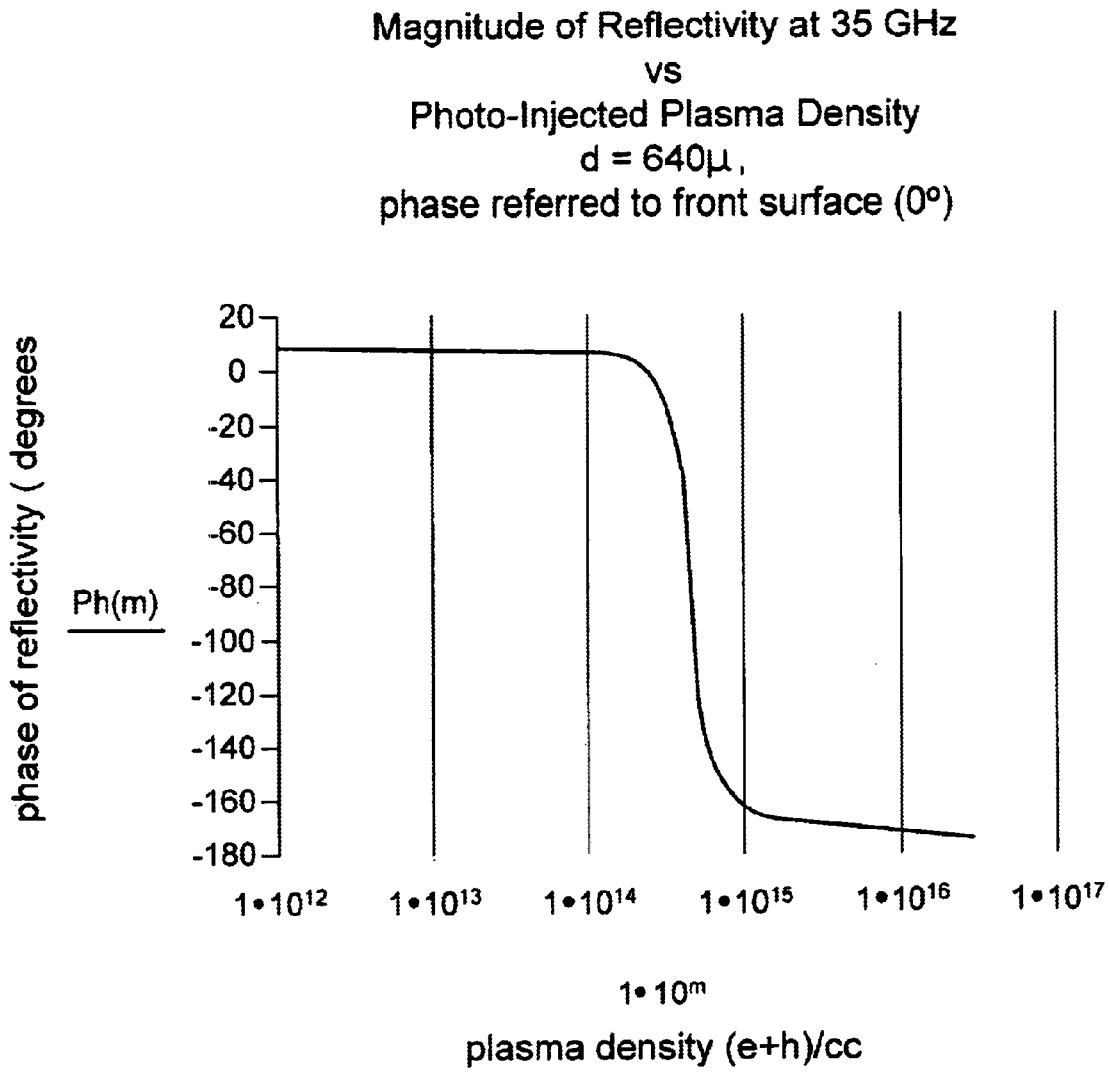
FIG. 9 illustrates the behavior of the phase of the reflectivity of an improved phase correcting FZP in accordance with the present invention; in this example, the same parameters of FIG. 8 were used; the wafer of thickness 640 $\mu$m ensures that the total phase change is 180° between the lowest plasma density on the left and the maximum plasma density of $2\times10^{16}$ $cm^{-3}$ on the right; one will note that changes in the maximum of an order of magnitude produce only slight changes from the ideal 180° phase shift.

FIG. 9 displays the phase of the reflectivity as a function of plasma density. With the wafer thickness of 640 $\mu$m, the total change in phase is exactly 180° from zero density to the highest density of $2\times10^{16}$ cm$^3$. A higher or lower maximum plasma density produces only a slight penalty in phase shift from 180°. For example, at a plasma density of $2\times10^{15}$ cm$^{-3}$ the shift in phase is changed by only 10°. Thus, the choice of maximum plasma density is not critical for the phase correcting FZP. However, the magnitude of the reflectivity, 0.9, is significantly higher at the higher plasma density.

To produce a photo-injected plasma density of $2\times10^{16}$ cm$^{-3}$ requires a light intensity of 0.3 W/cm$^2$ or 300 mW/cm$^2$, once again assuming a free carrier recombination time of 1000 $\mu$s. At this light intensity, the change in phase of 180° between MMW radiation in the in-phase zones 74 and the out-of-phase zones 72 is achieved as given in FIG. 6, producing an efficiency which approaches the ideal for this configuration of 40.5%.

Although the invention has been shown and described with respect to certain preferred embodiments, it is obvious that equivalents and modifications will occur to others skilled in the art upon the reading and understanding of the specification. For example, although the antenna 50 has been described primarily in the context of transmitting MMW radiation it will be appreciated that the antenna 50 may also operate as a receiving antenna for receiving MMW radiation. Moreover, although the antenna 50 is described as constituting a planar array of elements (e.g., light source, reflector, wafer, etc.), it will be appreciated that the elements may instead be curved or have some other shape without departing from the scope of the invention. Furthermore, although the antenna 50 is described primarily for operation in the MMW band, it will be appreciated that the antenna 50 could instead be designed to operate in other bands. The present invention includes all such equivalents and modifications, and is limited only by the scope of the following claims.

What is claimed is:

1. A plasma controlled reflector antenna, comprising:

a reflector configured to reflect radio frequency (RF) radiation having a frequency equal to that of an operating frequency of the antenna;

a feed for illuminating the reflector with and/or receiving from the reflector RF radiation at the operating frequency to transmit/receive RF radiation;

a Fresnel zone plate (FZP) wafer adjacent the reflector and interposed between the reflector and the feed, the FZP wafer having a thickness substantially equal to n*λvac/(4*N), where n is an odd integer, λvac is the free space wavelength of RF radiation at the operating frequency, and N is the index of refraction of a material of which the wafer is made, in a non-plasma injected state;

a controllable light source for projecting a controlled light pattern onto the FZP wafer to inject selectively plasma into regions of the FZP wafer illuminated by the light pattern, thereby creating regions in a plasma injected state and regions in a non-plasma injected state.

2. The antenna of claim 1, wherein RF radiation at the operating frequency which is incident on the regions in a plasma injected state incurs a 180° phase change on reflection at a front surface of the FZP wafer, and RF radiation at the operating frequency which is incident on the regions in a non-plasma injected state incurs a 180° phase change on reflection at the reflector.

3. The antenna of claim 1, wherein the controllable light source alters the light pattern projected on the FZP wafer in order to scan a beam of the antenna.

4. The antenna of claim 1, wherein the controllable light source and FZP wafer are configured so as to be operable in both a blocking FZP mode and a phase correcting FZP mode.

5. The antenna of claim 1, wherein the FZP wafer is made of silicon.

6. The antenna of claim 1, wherein the FZP wafer is made of germanium.

7. The antenna of claim 1, wherein the FZP wafer is made of a member of the category of III–V and II–VI compound semiconductors.

8. The antenna of claim 1, wherein the controllable light source is located on a side of the reflector opposite the FZP wafer, and the reflector is generally transparent to light at the frequency of the controllable light source.

9. The antenna of claim 1, wherein the controllable light source comprises an array of light emitting diodes (LEDs).

10. The antenna of claim 1, wherein the controllable light source comprises an array of solid state lasers.

11. The antenna of claim 1, wherein the controllable light source comprises a steered laser beam.

12. The antenna of claim 1, wherein the controllable light source emits light having a wavelength less than a band gap wavelength of the FZP wafer.

13. The antenna of claim 1, wherein the reflector comprises a metal mesh.

14. The antenna of claim 1, wherein the reflector comprises a grid of metal lines.

15. The antenna of claim 1, wherein the reflector is substantially transparent at the frequencies of the controllable light source, and is reflective at the operating frequency of the antenna.

16. The antenna of claim 1, wherein the operating frequency of the antenna is in the millimeter wave band.

17. The antenna of claim 1, wherein the operating frequency of the antenna is in the microwave band.

* * * * *